US011542778B2

(12) United States Patent
Bartlett et al.

(10) Patent No.: US 11,542,778 B2
(45) Date of Patent: Jan. 3, 2023

(54) BARRIER ARRANGEMENT IN WELLHEAD ASSEMBLY

(71) Applicant: Dril-Quip, Inc., Houston, TX (US)

(72) Inventors: Chris D. Bartlett, Spring, TX (US); Daniel J. McLaughlin, Katy, TX (US); Raymond Guillory, Houston, TX (US); Blake T. DeBerry, Houston, TX (US); Marcus Smedley, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 17/299,435

(22) PCT Filed: Dec. 4, 2019

(86) PCT No.: PCT/US2019/064485
§ 371 (c)(1),
(2) Date: Jun. 3, 2021

(87) PCT Pub. No.: WO2020/117943
PCT Pub. Date: Jun. 11, 2020

(65) Prior Publication Data

US 2022/0018214 A1 Jan. 20, 2022

Related U.S. Application Data

(60) Provisional application No. 62/775,672, filed on Dec. 5, 2018.

(51) Int. Cl.
*E21B 33/035* (2006.01)
*E21B 34/04* (2006.01)

(52) U.S. Cl.
CPC ..... *E21B 34/04* (2013.01); *E21B 33/035* (2013.01)

(58) Field of Classification Search
CPC ..... E21B 33/035; E21B 34/04
See application file for complete search history.

(56) References Cited

U.S. PATENT DOCUMENTS 5,971,077 A * 10/1999 Lilley ..... E21B 33/035 166/348
5,992,527 A * 11/1999 Garnham ..... E21B 34/04 166/379
6,357,529 B1 * 3/2002 Kent ..... E21B 34/04 166/344

(Continued)

OTHER PUBLICATIONS

International Preliminary Report on Patentability issued in related PCT Application No. PCT/US2019/064485 dated Jun. 17, 2021, 7 pages.

(Continued)

*Primary Examiner* — Matthew R Buck
(74) *Attorney, Agent, or Firm* — Baker Botts L.L.P.

(57) ABSTRACT

A subsea wellhead assembly having an arrangement of primary well barriers provided in equipment that is located within the well and/or the wellhead housing is provided. All of the well barriers may be located within the tubing hanger and/or the production tubing string extending into the wellbore. The subsea wellhead assembly also includes a flowline connection body placed atop the wellhead housing and fluidly coupled to the tubing hanger. None of the primary barriers for the well are located in the flowline connection body.

20 Claims, 4 Drawing Sheets

(56) References Cited

U.S. PATENT DOCUMENTS

| | | | | |
|---|---|---|---|---|
| 7,013,970 | B2 * | 3/2006 | Collie | E21B 29/08 166/89.1 |
| 8,881,827 | B2 * | 11/2014 | Bjerke | E21B 34/04 166/344 |
| 9,702,212 | B2 * | 7/2017 | Breda | E21B 33/035 |
| 10,240,424 | B2 * | 3/2019 | Brown | E21B 34/04 |
| 10,808,483 | B2 * | 10/2020 | Hosie | E21B 34/04 |
| 11,162,317 | B2 * | 11/2021 | Zaragoza Labes | E21B 33/076 |
| 2010/0071775 | A1 | 3/2010 | Ratcliffe | |
| 2012/0138159 | A1 | 6/2012 | Wordley et al. | |
| 2014/0060850 | A1 | 3/2014 | Voss et al. | |
| 2014/0299328 | A1 * | 10/2014 | Ray | E21B 7/12 166/358 |
| 2017/0089182 | A1 | 3/2017 | Witwer et al. | |
| 2017/0211355 | A1 | 7/2017 | Maher | |
| 2018/0283124 | A1 | 10/2018 | Hosie et al. | |

OTHER PUBLICATIONS

International Search Report and Written Opinion issued in related PCT Application No. PCT/US2019/064485 dated Mar. 23, 2020, 10 pages.

Examination Report issued in related Great Britain Patent Application No. GB2107482.8 dated Apr. 14, 2022, 5 pages.

* cited by examiner

BARRIER ARRANGEMENT IN WELLHEAD ASSEMBLY

CROSS-REFERENCE TO RELATED APPLICATIONS

The present application is a U.S. National Stage Application of International Application No. PCT/US2019/064485 filed Dec. 4, 2019, which claims priority to U.S. Provisional Application Ser. No. 62/775,672 filed on Dec. 5, 2018 both of which are incorporated herein by reference in their entirety for all purposes.

TECHNICAL FIELD

The present disclosure relates generally to wellhead systems and, more particularly, to an improved arrangement of well barriers in a wellhead assembly.

BACKGROUND

Conventional wellhead systems include a wellhead housing mounted on the upper end of a subsurface casing string extending into the wellbore. During a drilling procedure, a drilling riser and BOP are installed above a wellhead housing (casing head) to provide pressure control as casing is installed, with each casing string having a casing hanger on its upper end for landing on a shoulder within the wellhead housing. A tubing string is then installed through the wellbore. A tubing hanger connectable to the upper end of the tubing string is supported within the wellhead housing above the casing hanger(s) for suspending the tubing string within the casing string(s). Upon completion of this process, the well is temporarily suspended via a temporary barrier. The temporary barrier could be a wireline plug, a downhole isolation valve that is pressure cycled open, a downhole safety valve, heavy completion fluid, or any combination of the above. The temporary barrier will provide a barrier between the well and the environment prior to the well control devices, such as the blowout preventer (BOP) and marine riser, being disconnected from the well.

Once removed, the BOP is replaced by a permanent well control device, in the form of a subsea Christmas tree installed above the wellhead housing, with the tree having a valve to enable the oil or gas to be produced and directed into flow lines for transportation to a desired facility. The temporary well barriers are removed after the subsea tree is installed. The subsea tree then acts as the primary well control device while the tree is in production. The subsea tree has at least two well barriers in the production flowbore that allow the well to be remotely shut in if there is a situation on the platform or anywhere downstream of the tree that requires isolation of the well.

In the event that the subsea tree needs to be retrieved, one or more temporary barriers is re-installed into the well. This is typically accomplished by installing a running string and/or riser that allows for heavy completion fluid to be pumped into the wellbore, and a wireline plug is installed into the tubing hanger. Once these barriers are in place, the subsea tree may be removed. If an isolation valve that actuates closed by means of applying pressure cycles (e.g., full-bore isolation valve, or FBIV) is used during the initial installation, it cannot be shifted closed again remotely. As such, a different barrier will be installed in place of the FBIV, typically a wireline plug.

This process of setting additional barriers in the flowbore before retrieving a subsea tree from the wellhead is time consuming and expensive. It is now recognized that systems and methods to simplify or reduce the cost of such wellhead installation/servicing operations is desired.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business-related constraints, which will vary from one implementation to another. Moreover, it will be appreciated that such a development effort might be complex and time consuming but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to a wellhead assembly having an arrangement of primary well barriers provided in equipment that is located within the well and/or the wellhead housing. Specifically, all of the well barriers may be located within the tubing hanger and/or the production tubing string extending into the wellbore.

By including all the main well barriers within the tubing hanger and/or production tubing string, the "tree" that would otherwise be placed atop the wellhead will be greatly simplified. The "tree" portion of the wellhead assembly located atop the wellhead housing essentially functions as a well cap, or flowline connection body. As such, in disclosed embodiments, the term "tree" will be used to refer to a flowline connection body. This transformation of the "tree" into simply a flowline connection body means that this piece of equipment does not have to meet the code requirements for a subsea Christmas tree, but instead only has to meet flowline code requirements, which are different and less stringent than those of a subsea tree.

The "tree" in presently disclosed embodiments does not include any primary barriers that can be used to shut in the wellbore if there is a situation on the platform or anywhere downstream of the tree that requires isolation of the well. The wellhead assembly and associated components will include at least two such barriers for the production flowbore, but they will be located either within or upstream of the tubing hanger. There are numerous potential configurations of the equipment that facilitate movement of the primary well barriers from the subsea tree to other pieces of equipment at or below the wellhead. Example embodiments of improved barrier arrangements within the wellhead assembly will be provided and described below with reference to FIGS. 1-3.

Figure 1:
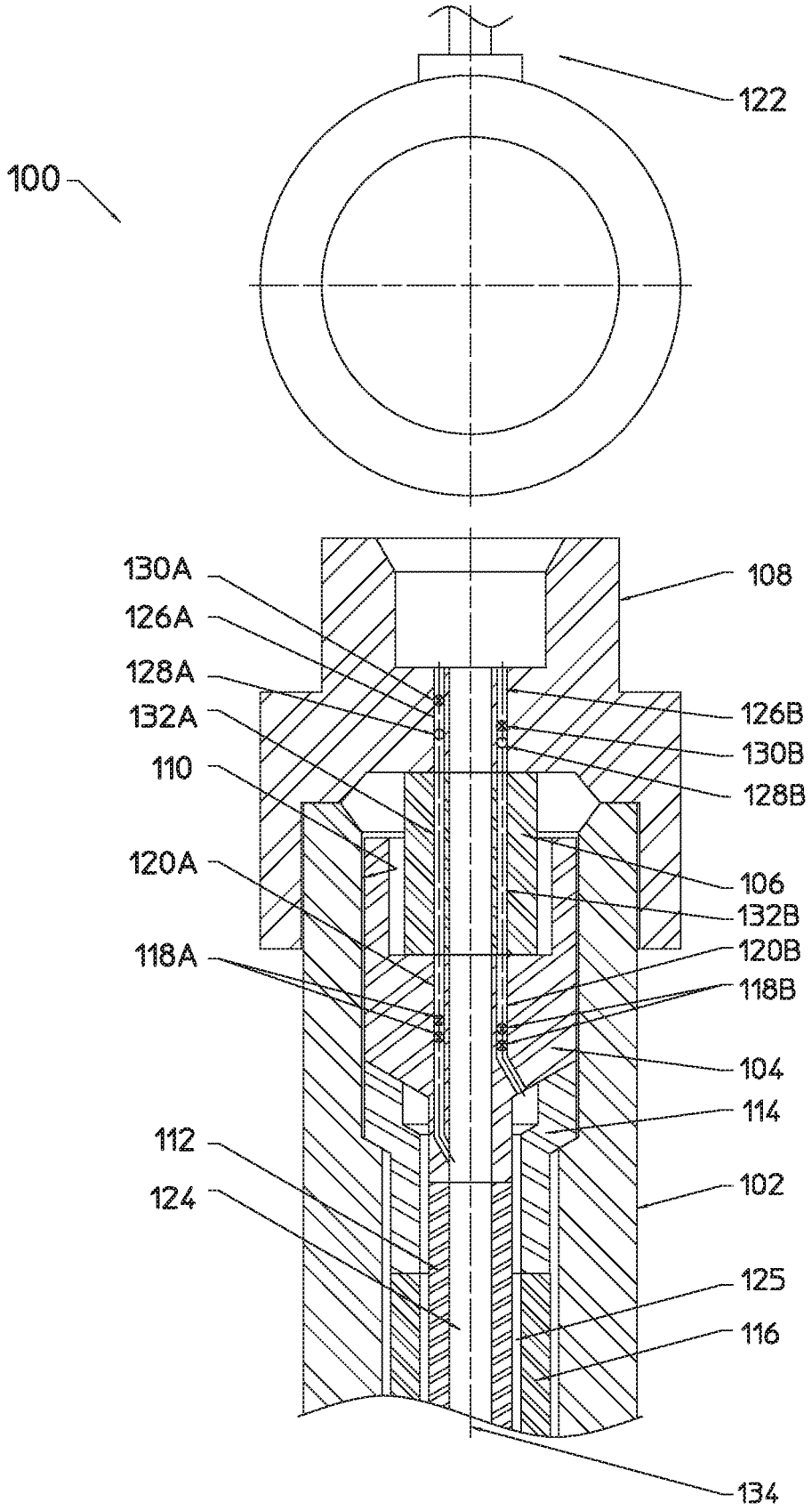
FIG. 1 is a partial cross sectional view of components of a subsea production system having an arrangement of well barriers within a tubing hanger, in accordance with an embodiment of the present disclosure.

Turning now to the drawings, FIG. 1 illustrates certain components of a subsea production system 100, which, has the primary well barriers located within a tubing hanger below the "tree" (flowline connection body). The subsea production system 100 may include a wellhead 102, a tubing hanger 104, a tubing hanger alignment device 106, and a flowline connection body 108. The tubing hanger 104 may be landed in and sealed against a bore 110 of the wellhead 102, as shown. The tubing hanger 104 may suspend a production tubing string 112 into and through the wellhead 102. Likewise, one or more casing hangers 114 may be held within and sealed against the bore 110 of the wellhead 102 and used to suspend corresponding casing strings 116 through the wellhead 102 and the wellbore below. The flowline connection body 108 may be connected to and sealed against the wellhead 102.

In presently disclosed embodiments, the tubing hanger 104 may include at least two well barriers (in the form of valves) 118A that may be actuated to fluidly couple a production flowpath 120A through the tubing hanger 104 to one or more downstream production flowpaths, such as one or more flowpaths through the tubing hanger alignment device 106, the flowline connection body 108, and a downstream well jumper 122. The tubing hanger 104 may also include one or more well barriers (in the form of valves) 118B that may be actuated to fluidly couple an annulus flowpath 120B through the tubing hanger 104 to the one or more downstream annulus flowpaths.

In the illustrated embodiment, the production flowpath 120A through the tubing hanger 104 is coupled at an upstream end to a main production flowbore 124 of the production tubing string 112 below. As illustrated, the barrier valves 118A may include at least two valves disposed along this production flowpath 120A through the tubing hanger 104. In other embodiments, the barrier valves 118A may include at least one valve disposed along the production flowpath 120A through the tubing hanger 104 and at least one other valve disposed along the main production flowbore 124 below the tubing hanger 104.

In the illustrated embodiment, the annulus flowpath 120B through the tubing hanger 104 is coupled at an upstream end to an annulus 125 between the production tubing sting 112 and the innermost casing 116. As illustrated, the barrier valve(s) 118B may include two valves disposed along this annulus flowpath 120B through the tubing hanger 104. In other embodiments, the barrier valve(s) 118B may include just one valve 118B disposed along the annulus flowpath 120B through the tubing hanger 104. In still other embodiments, the barrier valve(s) 118B may include at least one valve 118B disposed along the annulus flowpath 120B through the tubing hanger 104 and at least one annular valve disposed within the annulus 125 below the tubing hanger 104.

If an unexpected or undesired event occurs making it necessary to shut in the well, these barrier valves 118A and 118B may be actuated from an open position to a closed position to shut in the well. Conventional well systems generally include these primary barrier valves within a subsea tree located above the tubing hanger; however, the disclosed arrangement of these barrier valves 118 in the tubing hanger 104 (and/or below the tubing hanger 104) simplifies the construction, installation, and servicing of the "tree", which is the flowline connection body 108.

The barrier valves 118 may each include a ball valve, a flapper valve, a gate valve, an annular valve, or any desired types of valve capable of acting as a well barrier. The barrier valves 118 may be remotely actuatable so that they can be activated quickly to shut in the well as needed. Details of the controls used to actuate various valves within the disclosed subsea production system 100 are provided below with reference to FIGS. 2 and 3.

The flowline connection body 108 may include a production flowpath 126A and an annulus flowpath 126B extending therethrough to fluidly connect the flowpaths 120A and 120B, respectively, to the well jumper 122. Flowpaths 128A and 128B may extend horizontally from the vertical bores 126A and 126B to a well jumper connection interface. It should be noted that other relative orientations of these flowpaths 126 and 128 may be possible in other embodiments. The flowline connection body 108 may include one or more valves disposed therein, although these are not barrier valves capable of shutting in the well. For example, the flowline connection body 108 may include a production swab valve 130A located along the flowpath 126A, and an annulus swab valve 130B located along the flowpath 126B. The swab valves 130A and 130B allow vertical access into the production bore of the well; the swab valves 130A and 130B also facilitate a circulation flowpath during certain well conditioning operations.

As shown, the tubing hanger alignment device 106 may connect the flowline connection body 108 to the tubing hanger 104. The tubing hanger alignment device 106 may include a production flowpath 132A extending therethrough for fluidly connecting the flowpath 120A of the tubing hanger 104 to the flowpath 126A of the flowline connection body 108. The tubing hanger alignment device 106 may similarly include a production flowpath 132B extending therethrough for fluidly connecting the flowpath 120B of the tubing hanger 104 to the flowpath 126B of the flowline connection body 108. Although these flowpaths 132 are illustrated as being side by side in the cross-sectional view, it should be noted that in certain embodiments these flowpaths 132 through the tubing hanger alignment device 106 may be concentric, with one being a central flowpath and the other being an annular space surrounding the central flowpath. The tubing hanger alignment device 106 may further include one or more communication lines (e.g., hydraulic fluid lines, electrical lines, and/or fiber optic cables), which are not shown, disposed therethrough and used to communicatively couple the flowline connection body 108 to the tubing hanger 104.

The tubing hanger 104 may include couplings or stabs located at the top of the tubing hanger 104 in a specific orientation with respect to a longitudinal axis 134. The tubing hanger alignment device 106 is configured to facilitate a mating connection that communicatively couples the flowline connection body 108 to the couplings/stabs on the tubing hanger 104 as the flowline connection body 108 is landed onto the wellhead 102, regardless of the orientation in which the flowline connection body 108 is initially positioned during the landing process.

The disclosed subsea production system 100 allows for the flowline connection body 108 (or "tree", or well cap) to be installed and later retrieved without requiring certain steps to be performed. Specifically, when it is desired to retrieve the flowline connection body 108 for repairs or maintenance, this can be accomplished without providing a pressure containing conduit (e.g., marine riser) and installing wireline plugs to act as temporary well barriers. This is because the main well barriers 118 are already located within the equipment below the flowline connection body 108. If the flowline connection body 108 is to be removed, this is accomplished by first closing the barrier valves 118 in the tubing hanger 104 and/or the well so that the well is protected during the retrieval procedure.

By eliminating the relatively large well barriers from the "tree" (flowline connection body 108), this reduces the size, weight, and cost of the flowline connection body 108, as compared to existing systems having a subsea tree with the well barriers. The disclosed subsea production system 100 enables a simplified flowline connection body 108 to be used in place of this typical subsea tree. The simplified design of the flowline connection body 108 also allows for a simplified control system to be used with the subsea wellhead assembly.

Figure 2:
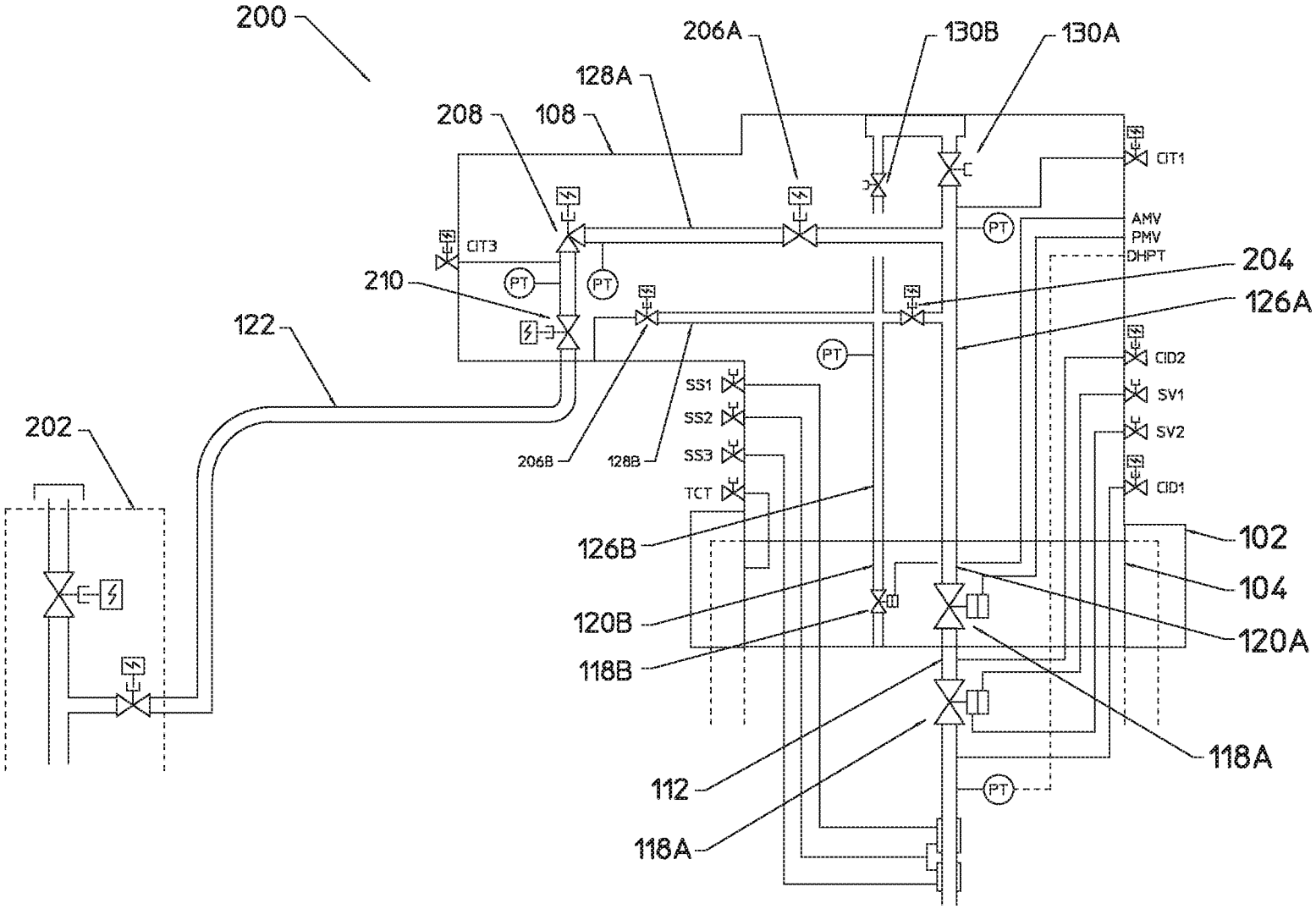
FIG. 2 is a schematic diagram of components of a subsea production system including a manifold and an arrangement of well barriers disposed in the wellhead, tubing hanger, and/or well completion string, in accordance with an embodiment of the present disclosure.

FIG. 2 is a schematic illustrating an embodiment of a subsea production system 200 with the improved arrangement of well barriers 118, which allows for more simplified controls for the wellhead assembly. The subsea production system 200 enables a streamlined process for retrieving the flowline connection body 108 if needed during production operations.

As illustrated, the flowline connection body 108 connects the production flowpath 120A through the tubing hanger 104 with the flowline jumper 122 that provides production fluid to a subsea production manifold 202. In this embodiment, one of the main barrier valves 118A (a production master valve, or PMV) is located along the production flowpath 120A within the tubing hanger 104. The other of the main barrier valves 118A (a surface controlled subsurface safety valve, or SCSSV) is located upstream of the tubing hanger 104 within the main flowbore of the production tubing string 112. The main annulus barrier valve 118B (an annulus master valve, or AMV) is located along the annulus flowpath 120B within the tubing hanger 104. As such, none of the main barrier valves 118 for the subsea production system 200 are located in the flowline connection body 108.

Although the flowline connection body 108 does not include the main barrier valves 118, the flowline connection body 108 may still include a number of additional valves that are held to lower code requirements. These valves may include, for example, a production swab valve (PSV) 130A and annulus swab valve (ASV) 130B, a crossover valve (XOV) 204 between the production flowpath 126A and the annulus flowpath 126B, a production wing valve (PWV) 206A and annulus wing valve (AWV) 206B, a pressure control valve (PCV) 208, and a process shut down valve (PSDV) 210. The swab valves 130 provide vertical access for wireline or coiled tubing operations as well as a circulation flowpath when intervention is required in the well. The XOV 204 allows fluid and/or pressure to be circulated or bled down from the annulus to the production flowpath 126A. The wing valves 206 are historically the most actively actuated valves that are operated with the intent of not wearing out the master valves. The PCV 208 controls the flowing pressure of the well, so that the well may be manifolded with other producing wells within the subsea system. The PSDV 210 is used as a sacrificial valve operated first or last in a sequence of operations to receive the wear and tear caused by any sand production through the system.

The disclosed streamlined subsea production system 200 may offer various advantages over existing subsea systems that have the main barrier valves located in a subsea tree above the wellhead. In the illustrated embodiment, the flowline connection body 108 has space for several valves to be disposed therein due to the space savings from having the main barrier valves 118 located elsewhere. By having all these valves (130, 204, 206, 208, and 210) located in the flowline connection body 108, this allows a single compact manifold 202 to be used for connecting the production flowline of the subsea system 200 to a topsides facility. Using the compact header manifold 202 reduces the size, complexity, and weight of the overall subsea production system 200, thereby reducing the time and cost for installation. The compact manifold 202 may be attached to the flowline connection body 108 via a flexible jumper 122, as opposed to a larger, more structured jumper assembly, thereby providing jumper installation savings. Having the PMV 118A in the tubing hanger 104 facilitates riser light well intervention (RLWI) access. Additionally, having the PMV 118A in the tubing hanger 104 eliminates the need for a full-bore isolation valve (FBIV) to be used during the initial installation of the wellhead assembly and allows for isolation of the main production flowbore during future interventions without setting a temporary plug.

Figure 3:
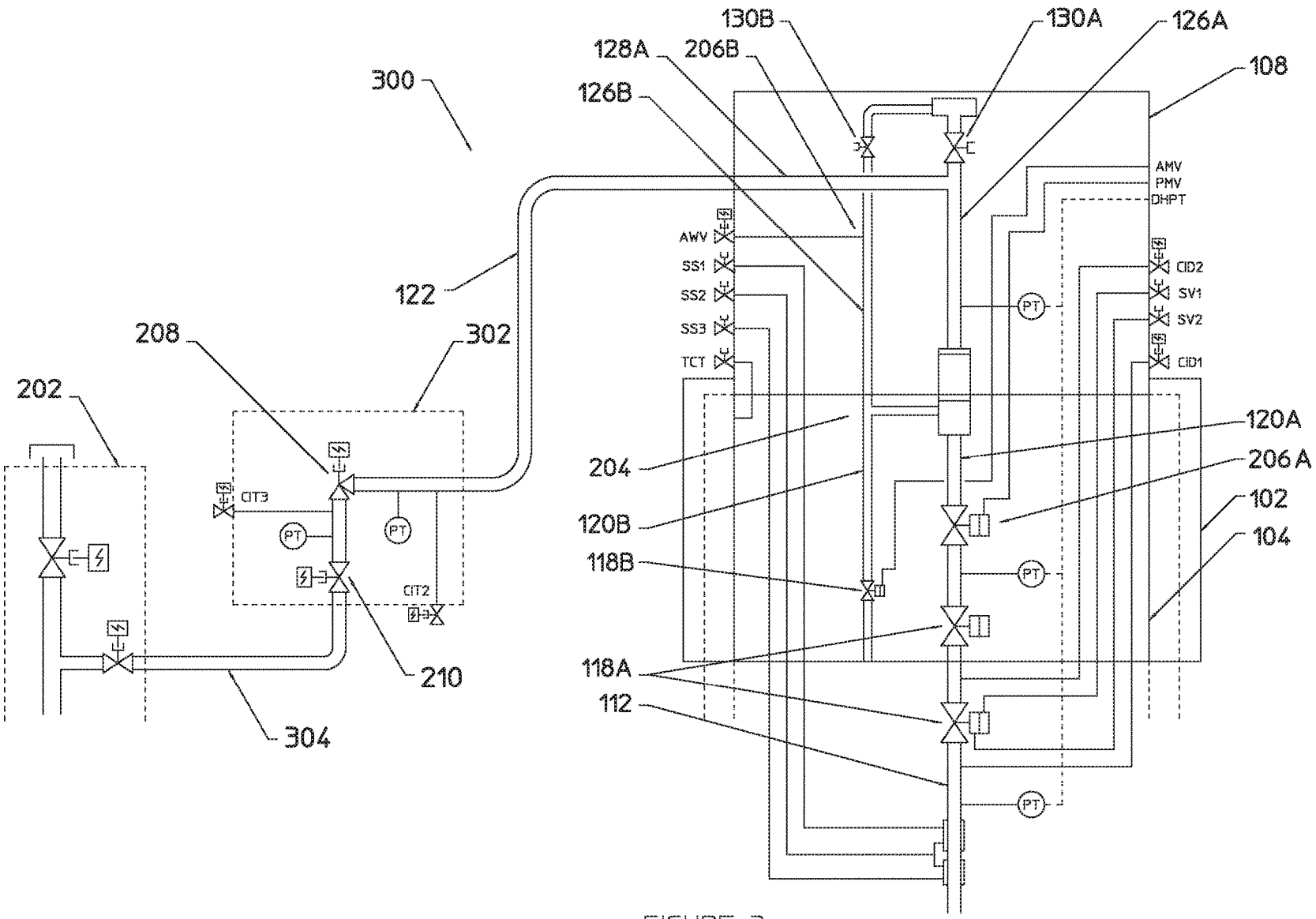
FIG. 3 is a schematic diagram of components of a subsea production system including a flow modulo, a manifold, and an arrangement of well harriers disposed in the wellhead, tubing hanger, and/or well completion string, in accordance with an embodiment of the present disclosure.

FIG. 3 is a schematic illustrating an embodiment of a subsea production system 300 with the improved arrangement of well barriers 118, which allows for more simplified controls for the wellhead assembly. The subsea production system 300 enables a streamlined process for retrieving the flowline connection body 108 if needed during production operations.

As illustrated, the flowline connection body 108 connects the production flowpath 120A through the tubing hanger 104 with the flowline jumper 122 that provides production fluid to a flow module 302, which then communicates production fluid through another jumper 304 to a subsea production manifold 202. In this embodiment, one of the main barrier valves 118A (PMV) is located along the production flowpath 120A within the tubing hanger 104. The other of the main barrier valves 118A (SCSSV) is located upstream of the tubing hanger 104 within the main flowbore of the production tubing string 112. The main annulus barrier valve 118B (AMV) is located along the annulus flowpath 120B within the tubing hanger 104. As such, none of the main barrier valves 118 for the subsea production system 300 are located in the flowline connection body 108. The flowline connection body 108 is reduced to just a connection interface between the tubing hanger 104/wellhead 102 and the flowline jumper 127.

In the illustrated embodiment, the flowline connection body 108 may include a smaller number of additional valves (or zero valves) than are used in the flowline connection body 108 of FIG. 2. For example, as shown, the flowline connection body 108 may include a PSV 130A and ASV 130B. However, the function of the PSV 130A may similarly be accomplished using a plug set in the flowpath 126A. In still other embodiments, these swab valves 130 may be eliminated entirely from the design of the flowline connection body 108. Additional valves may be included in the tubing hanger 104 and/or the separate flow module 302. For example, in the illustrated embodiment, the XOV 204, PWV 206A, and AWV 206B are each located in the tubing hanger 104, while the PCV 208 and the PSDV 210 are located within the separate flow module 302. With the well kill valves (PCV 208 and PSDV 210) located in the separate flow module 302, the swab valves 130 in the flowline connection body 108 are not required.

If other fluid access points are contained in the subsea production system 300, such as at the flowline connection body 108 or a separate intervention point, heavy well fluids can be injected into the well as a first barrier, and the additional well barrier valves 118 may be closed to create a secondary barrier as needed. All that is needed to provide this function is fluid access to the production system. There is no need for vertical access to the flowline connection body 108 and/or the wellhead 102, since there is no need for installing wireline plugs to create a barrier during well intervention operations.

The disclosed subsea production system 300 may offer various advantages over existing subsea systems that have the main barrier valves located in a subsea tree above the wellhead. By having the well harriers 118 located in the tubing hanger 104, and all the additional valves (130, 204, 206, 208, and 210) distributed between the tubing hanger 104 and the flow module 302, the space taken up by the flowline connection body 108 is greatly reduced, even compared to the embodiment of FIG. 2. This leads to a reduced cost for installation of the flowline connection body 108. The separate flow module 302 allows flexibility for changing and adapting to future well issues. In addition, the illustrated arrangement of valves means that a single compact manifold 202 may be used for connecting the production flowline of the subsea system 300 to a topsides facility. Using the compact header manifold 202 reduces the size, complexity, and weight of the overall subsea production system 300, thereby reducing the time and cost for installation. The compact manifold 202 may be attached to the flow module 302, and the flow module 302 to the flowline connection body 108, via flexible jumpers 304 and 122, respectively, as opposed to larger, more structured jumper assemblies. This provides jumper installation savings. Having the PMV 118A in the tubing hanger 104 facilitates riser light well intervention (RLWI) access. Additionally, having the PMV 118A in the tubing hanger 104 eliminates the need for a full-bore isolation valve (FBIV) to be used during the initial installation of the wellhead assembly and allows for isolation of the main production flowbore during future interventions without setting a temporary plug.

Figure 4:
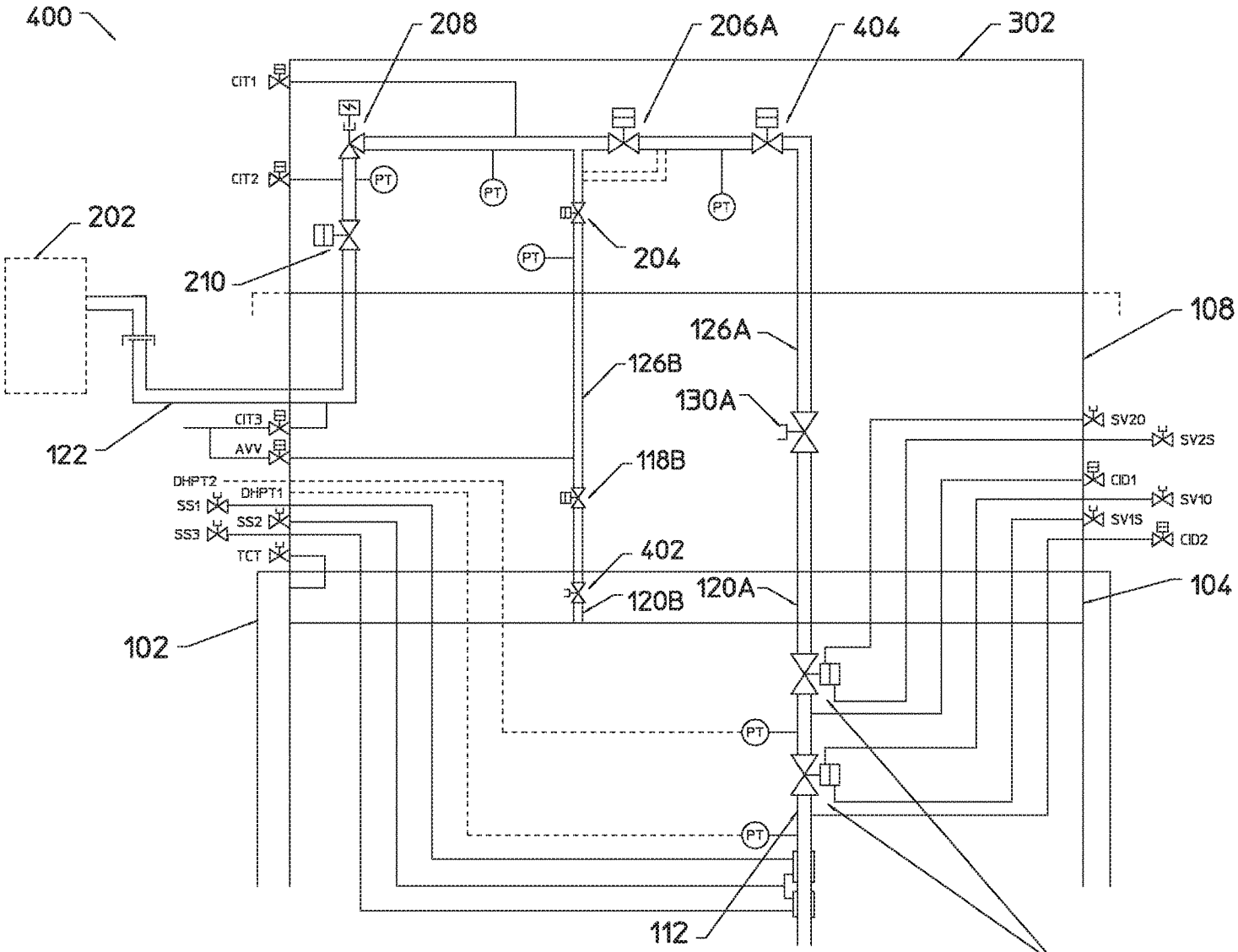
FIG. 4 is a schematic diagram of components of a subsea production system including a flow module located on an upper surface of the flowline connection body, a manifold, and an arrangement of well barriers disposed in the wellhead and/or well completion string, in accordance with an embodiment of the present disclosure.

FIG. 4 is a schematic illustrating an embodiment of a subsea production system 400 with the improved arrangement of well barriers 118, which allows for more simplified controls for the wellhead assembly. The subsea production system 400 enables a streamlined process for retrieving the flowline connection body 108 if needed during production operations. The subsea production system 400 of FIG. 4 is similar to that of FIG. 3, except the features and benefits from the separate flow module 302 of FIG. 3 are incorporated and located directly above the flowline connection body 108. The flow module 302 essentially becomes an upper portion of the flowline connection body 108, as illustrated in FIG. 4. This eliminates the need for two connecting jumpers leading from the flowline connection body 108 to the manifold 202. Only one flowline jumper 122 is used to provide production fluid to the manifold 202.

As illustrated, the flowline connection body 108 connects the production flowpath 120A through the tubing hanger 104 with the above flow module 302, which then communicates production fluid back to the flowline connection body 108. The flowline connection body 108 then communicates this production fluid through a jumper 122 to the subsea production manifold 202. The flow module 302 is located directly above and mounted to an upper portion of the flowline connection body 108, as illustrated.

In the illustrated embodiment, there are no main barrier valves (PMV) located along the production flowpath 120A within the tubing hanger 104. Instead, one PMV 118A is located in the production tubing string 112 just upstream of the tubing hanger 104 (i.e., the second SCSSV 118A below the tubing hanger 104). In this manner, the subsea production system 400 effectively has two main barrier valves 118A in the form of SCSSVs located upstream of the tubing hanger 104. None of the main production barrier valves 118A for the subsea production system 400 are located in the flowline connection body 108. The flowline connection body 108 is reduced to just a connection interface between the tubing hanger 104/wellhead 102 and the flow module 302 above leading to the flowline jumper 122. The main annulus barrier valve 118B (AMV) is located along the annulus flowpath 126B within the flowline connection body 108. The tubing hanger 104 also includes an annulus access valve (AAV) 402 located along the annulus flowpath 120B, and this AAV 402 is an ROV operated valve that acts as a temporary barrier.

In the illustrated embodiment, the flowline connection body 108 may include a smaller number of valves than are used in the flowline connection body 108 of FIG. 2. For example, as shown, the flowline connection body 108 may include a PSV 130A and AMV 118B. The PSV 130A can act as a temporary barrier in the place of a wireline plug or other barrier device if the need arises to remove and/or replace the upper flow module 302. Additional valves may be included in the tubing hanger 104 and/or the upper flow module 302. For example, in the illustrated embodiment, the AAV 402 is located in the tubing hanger 104, while the XOV 204, PWV 206A, PCV 208, and PSDV 210 are located within the upper flow module 302. With the well kill valves (PCV 208 and PSDV 210) located in the flow module 302, an annulus swab valve in the flowline connection body 108 is not required. In some embodiments, air optional additional production main barrier (PMV) 404 may be located within the flow module 302.

The disclosed subsea production system 400 may offer various advantages over existing subsea systems that have the main barrier valves located in a subsea tree above the wellhead. The upper flow module 302, being a separate component from the flowline connection body 108, allows flexibility for changing and adapting to future well issues. For example, if it is desirable to add a choke and a flow meter, those components may be accommodated within the flow module 302. In addition, the illustrated arrangement of valves means that a single compact manifold 202 may be used for connecting the production flowline of the subsea system 400 to a topsides facility. Using the compact header manifold 202 reduces the size, complexity, and weight of the overall subsea production system 400, thereby reducing the time and cost for installation. The compact manifold 202 may be attached to the flowline connection body 108 via a single flexible jumper 122, as opposed to a larger, more structured jumper assembly. This provides jumper installation savings. In the subsea production system 400 of FIG. 4, the valves (204, 206A, 108, 210, and/or 404) within the flow module 302 can be oriented vertically, drastically reducing the size, weight, and cost of the overall wellhead assembly.

Referring to FIGS. 2-4, the disclosed subsea production systems 200, 300, and 400 allow for more efficient actuation means than is currently available using production systems with barriers located in a subsea tree. For example, several valves (130, 204, 206, 208, and 210) may be electrically actuated, since the requirements for closure of such fail-safe valves are not the same as the requirements for closing the well barrier valves 118. The simplified control system is illustrated as various controls positioned along the sides of the flowline connection body 108. This control system may be more distributed to serve components in multiple locations and may be largely electric instead of hydraulic. Such electric operation of valves in the subsea production systems 200 and 300 reduces the hydraulic control fluid consumption in those embodiments. In addition, electric operation of the valves allows for more operating components of the subsea production systems 200 and 300 to be installable and replaceable using a remote operated vehicle (ROV).

The subsea production systems disclosed herein enable standardization of equipment, since the tubing hanger 104 (with the flowline connection body 108) provides essential well barriers 118 that are not project specific. All potential well-specific equipment is instead housed in the downstream flowline jumper equipment (e.g., manifold 202 and/or flow module 302). The subsea production systems disclosed herein allow the downstream project-specific equipment to be configured as needed in a more bolt-together fashion, since the main well barriers 118 are integrated into the wellhead assembly in such a way that a BOP can connect to and control the well in an emergency. More equipment can be retrieved and serviced as a single package, as opposed to building multiple pieces with the capability of them being independently retrievable.

Although the present disclosure and its advantages have been described in detail, it should be understood that various changes, substitutions and alterations can be made herein without departing from the spirit and scope of the disclosure as defined by the following claims.

What is claimed is:

1. A system, comprising:

a tubing hanger positioned in a wellhead housing;

a production tubing string coupled to and extending from the tubing hanger into a well;

a flowline connection body fluidly coupled to the tubing hanger and disposed atop the wellhead housing;

two primary production barrier valves, wherein each of the primary production barrier valves is disposed either along a production flowpath within the tubing hanger or upstream of the tubing hanger along a main production flowbore of the production tubing string; and at least one annulus barrier valve disposed along an annulus flowpath within the tubing hanger, the annulus flowpath being fluidly coupled to an annulus flowpath of the flowline connection body;

wherein the flowline connection body does not include a primary production barrier valve capable of shutting in the well.

2. The system of claim 1, wherein the flowline connection body further comprises:

a production swab valve disposed along a production flowpath within the flowline connection body, wherein the production swab valve provides vertical access to the production flowpath within the flowline connection body;

a production wing valve disposed along the production flowpath within the flowline connection body downstream from the two primary production barrier valves;

a pressure control valve disposed along the production flowpath within the flowline connection body downstream of the production wing valve; and a process shut down valve disposed along the production flowpath within the flowline connection body downstream of the pressure control valve.

3. The system of claim 2, wherein the flowline connection body further comprises:

an annulus swab valve disposed along an annulus flowpath within the flowline connection body, wherein the annulus swab valve provides vertical access to the annulus flowpath within the flowline connection body; and an annulus wing valve disposed along the annulus flowpath within the flowline connection body downstream from an annulus flowpath within the tubing hanger.

4. The system of claim 3, wherein the flowline connection body further comprises a crossover valve disposed between the production flowpath within the flowline connection body and the annulus flowpath within the flowline connection body.

5. The system of claim 1, further comprising a jumper and a manifold, wherein the jumper couples the manifold to the flowline connection body.

6. The system of claim 1, further comprising:

a crossover valve disposed between the production flowpath and the annulus flowpath within the tubing hanger.

7. The system of claim 1, further comprising:

a flow module coupled to the flowline connection body via a first jumper; and a manifold coupled to the flow module via a second jumper.

8. The system of claim 7, wherein the flow module further comprises a pressure control valve and a process shut down valve.

9. The system of claim 1, wherein both of the two primary production barrier valves are disposed along the production flowpath within the tubing hanger.

10. The system of claim 1, wherein one of the two primary production barrier valves is disposed along the production flowpath within the tubing hanger, and the other of the two primary production barrier valves is disposed upstream of the tubing hanger along the main production flowbore of the production tubing string.

11. The system of claim 1, wherein both of the two primary production barrier valves are disposed upstream of the tubing hanger along the main production flowbore of the production tubing string.

12. The system of claim 1, further comprising:

a production wing valve disposed along the production flowpath within the tubing hanger; and an annulus wing valve disposed along the annulus flowpath within the flowline connection body.

13. A system, comprising:

a tubing hanger positioned in a wellhead housing;

a production tubing string coupled to and extending from the tubing hanger into a well;

a flowline connection body fluidly coupled to the tubing hanger and disposed atop the wellhead housing;

at least two primary production barrier valves located upstream of the tubing hanger within the production tubing string; and a flow module coupled to and disposed above the flowline connection body, wherein the flow module comprises a production wing valve disposed along a production flowpath within the flow module.

14. The system of claim 13, further comprising a barrier valve disposed along an annulus flowpath within the flowline connection body.

15. The system of claim 13, further comprising an annular access valve disposed along an annulus flowpath within the tubing hanger.

16. The system of claim 13, further comprising a production swab valve disposed along a production flowpath within the flowline connection body.

17. The system of claim 13, wherein the flow module further comprises:

a crossover valve disposed along an annulus flowpath within the flow module, wherein the annulus flowpath within the flow module couples to the production flowpath within the flow module downstream of the production wing valve.

18. The system of claim 13, wherein the flow module further comprises a third primary production barrier valve.

19. The system of claim 13, further comprising a jumper and a manifold, wherein the jumper couples the manifold to the flow module.

20. The system of claim 13, wherein the flow module further comprises:

a pressure control valve disposed along the production flowpath within the flow module downstream of the production wing valve; and a process shut down valve disposed along the production flowpath within the flow module downstream of the pressure control valve.

* * * * *